US005186382A

United States Patent [19]

Doughty

[11] Patent Number: 5,186,382

[45] Date of Patent: Feb. 16, 1993

[54] METHOD OF MAKING PATIO CHAIRS WITH METAL SLATS

[75] Inventor: Fred C. Doughty, South Pasadena, Calif.

[73] Assignee: Brown Jordan Company, El Monte, Calif.

[21] Appl. No.: 734,525

[22] Filed: Jul. 23, 1991

[51] Int. Cl.[5] ..... B23K 31/02

[52] U.S. Cl. ..... 228/135; 228/170; 228/182; 297/447

[58] Field of Search ..... 228/170, 173.4, 135, 228/182; 297/445, 447, 448; 29/890.148, 33 T; 83/188

[56] References Cited

U.S. PATENT DOCUMENTS

| | | | |
|---|---|---|---|
| 3,698,274 | 10/1972 | Covlon et al. | 83/188 |
| 4,674,799 | 6/1987 | Schwartz et al. | 297/445 |
| 4,679,289 | 7/1987 | Miller | 83/188 X |
| 5,090,611 | 2/1992 | Takikawa et al. | 29/890.148 |

*Primary Examiner*—Kenneth J. Ramsey
*Attorney, Agent, or Firm*—Christie, Parker & Hale

[57] ABSTRACT

A metal patio chair has a seat frame made by the steps of providing a pair of seat rails in the form of elongated metal tubes, placing a mandrel inside each tube to reinforce the wall of the tube, punching a series of spaced apart holes in the wall of the tube while the mandrel contained in the tube holds the shape of the tube while punching out the holes, removing the mandrel, providing a plurality of metal slats having a cross-sectional shape to match the shape of the holes punched in the seat rail tubes, inserting ends of the metal slats in corresponding pairs of holes formed in the tubes to form a ladder type chair frame in which opposite ends of the slats are held captive in corresponding holes in the tubes, and are rigidly securing the slats to the seat rail tubes to lock the slats in palce in the tubes to provide a rigid seat frame structure elevated above the ground by a supporting sub-structure to which the finished seat frame is attached.

13 Claims, 4 Drawing Sheets

10
16
50
52
26
62
18
53
20
18
54
64
22
14
19
12
34
32
62
46
18
24
60
28
36
40
42
48
44

METHOD OF MAKING PATIO CHAIRS WITH METAL SLATS

FIELD OF THE INVENTION

This invention relates generally to outdoor patio furniture, and more particularly, to a method for making patio chairs with metal slats.

BACKGROUND OF THE INVENTION

Outdoor patio furniture manufacturers are constantly seeking to develop new product designs and new ideas for reducing manufacturing costs and time. Patio furniture can be custom made or manufactured in relatively low quantities from wrought iron or wood. The more traditional patio furniture is mass produced in many attractive and distinctive designs and color combinations. Typical of these designs are the casual outdoor furniture products made from welded tubular aluminum framing with a tough baked enamel finish and seating of vinyl lacing or nylon. The outdoor furniture of this type is durable for full time outdoor use.

Certain outdoor furniture designs are more easily manufactured from one type of material than another. For example, outdoor patio furniture made of wood can have the seating surfaces and chair backs made of spaced apart, horizontal slats in a ladder type of frame design. These types of chairs are also reasonably easy to manufacture in cheap plastic outdoor patio chair designs.

It would be desirable to manufacture patio chairs with seating surfaces in a ladder frame style with metal slats so that these chairs can have attractive designs that look somewhat like slatted patio furniture made of wood. However, fabrication and assembly techniques common to the manufacture of metal patio furniture cannot be used to make slatted metal patio furniture if these techniques result in designs which are not pleasing aesthetically. For instance, visible welds used to fasten the slats to the chair rails are undesirable. Large wide open and visible slots for holding the slats in the chair rails also are undesirable. In addition, the techniques used for manufacturing slatted metal patio furniture must be adaptable to mass production techniques at reasonably low cost and assembly time.

The present invention provides techniques for manufacturing patio chairs in a ladder frame style with metal slats which allows these chairs to be made in attractive designs having the appearance of slatted patio chairs made of wood. Metal patio chairs made from this method can be manufactured in attractive designs with low manufacturing costs and time. A significant advantage is that the chair avoids the problems of similar patio chairs made of wood which are prone to weathering and lack the same level of strength and durability for full-time outdoor use. The chair of this invention is particularly useful in withstanding high volume use, such as in hotels and motels, where the chairs are subject to abuse and are needed for full-time outdoor use.

SUMMARY OF THE INVENTION

Briefly, one embodiment of this invention comprises a method for making patio chairs in which a seat frame of the chair has metal slats assembled into a rigid seat frame unit by a method which includes the steps of providing a pair of seat rails in the form of elongated metal tubes, placing a mandrel inside each tube to reinforce the wall of the tube, punching a series of longitudinally spaced apart holes in the wall of each tube while the mandrel contained in the tube holds the shape of the tube when punching the holes, followed by removing the mandrel from each tube. A plurality of metal slats having a cross-sectional shape to match the shape of the holes punched into the seat rail tubes are inserted into corresponding pairs of holes formed in a pair of parallel seat rail tubes. This forms a ladder-type frame in which opposite ends of the slats are held captive in corresponding holes in the seat rail tubes. The captive slats are rigidly secured to the seat rail tubes, preferably by welding certain slots to the side tubes, to lock the slats in place in the tubes and thereby provide a rigid seat frame structure elevated above the ground by a supporting sub-structure to which the finished seat frame is attached.

In one form of the invention, the pair of seat rail tubes can be bent into a uniform generally L-shaped configuration of the seat frame to form a lower seat section and an upper backrest section of the seat frame. Slats in the seat portion of the frame are rigidly affixed to the seat rail tubes by welding the ends of the slats to the tubes, preferably underneath the seat frame section so that the welds are not visible. At least one of the slats on the upright backrest section is welded at opposite ends to the seat rail tubes to provide rigidity to the frame for locking all other slats in the seat frame, whether or not the slats are welded to the side rail tubes. Preferably, the slat welded to the backrest tube sections is welded inside the tubes so the welds are not visible. The welded slats act as rigid stretcher bars to provide a rigid seat frame structure.

Thus, the slatted chair frame can be made entirely of metal, preferably a durable, light weight metal such as aluminum. The mandrel used in forming the holes for the slats reinforces the wall of the tubing so it does not collapse when punching the holes in the tubes. The slats are readily assembled in the holes and welded to the tubes to form the rigid chair frame structure. The individual holes for the slats and the hidden welds enhance the aesthetic appearance and design features of the chair.

These and other aspects of the invention are more fully understood by referring to the following detailed description and the accompanying drawings.

DETAILED DESCRIPTION

Figure 1:
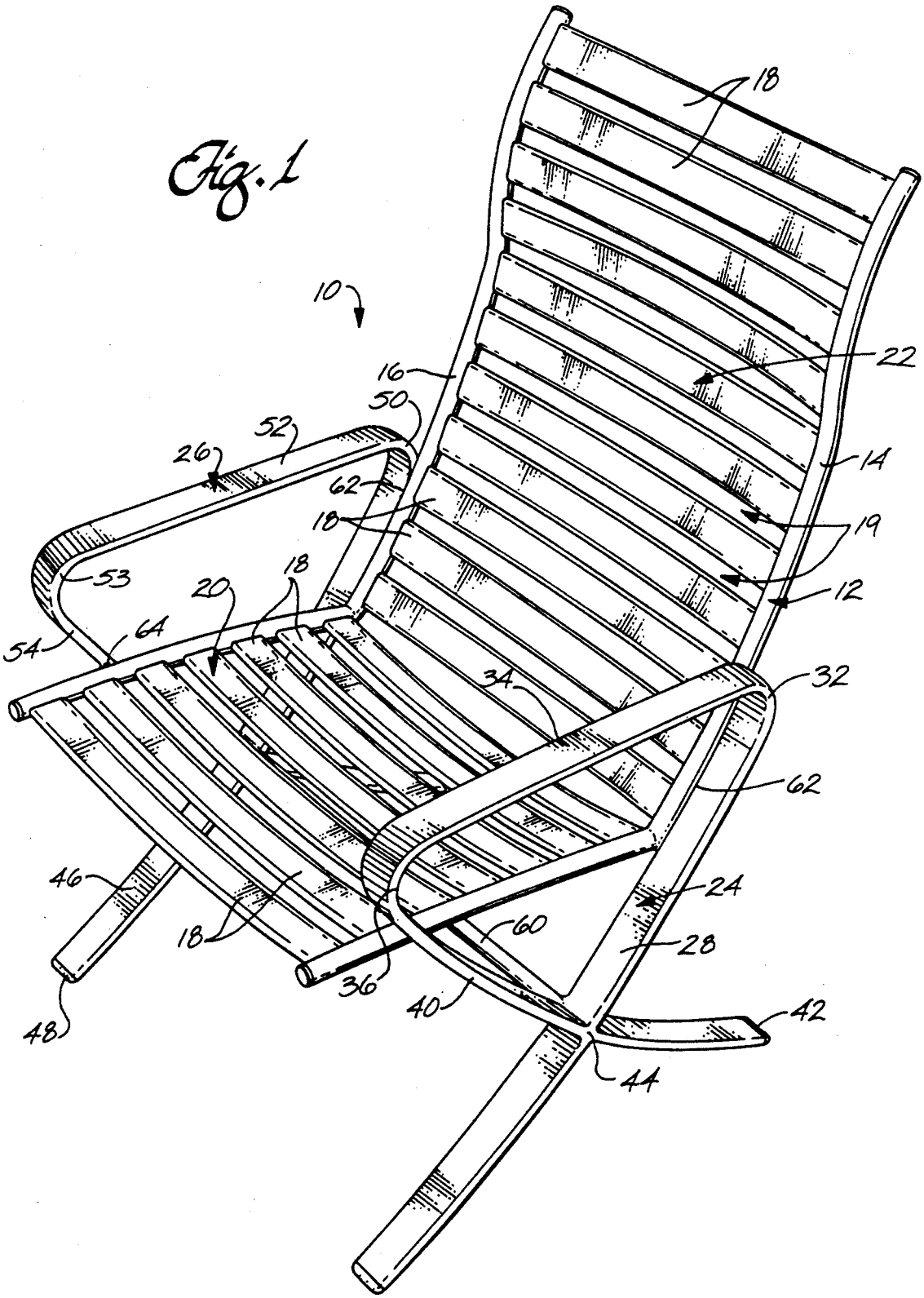
FIG. 1 is a front perspective view of a metal patio chair manufactured according to principles of this invention.

Referring to the drawings, FIG. 1 is a perspective illustrating a metal patio chair 10 according to principles of this invention. The chair 10 includes a generally L-shaped seat frame 12 made of metal parts assembled and welded together as a rigid unit. The seat frame includes left and right tubular seat rails 14 and 16 extending parallel to one another along the left and right sides of the seat frame, respectively. The tubular seat rail tubes are made of metal, preferably aluminum. The seat frame further includes a series of parallel, spaced apart, elongated metal slats 18 spanning the distance between the left and right seat rails along the length of the seat frame. The metal slats extend perpendicularly to the seat rails and the slats are preferably relatively wide in the plane of the left and right seat rails while being spaced apart by narrow parallel spaces 19 along the length of the seat frame. The ends of the metal slats are held captive in corresponding spaced apart holes along the length of the seat rail tubes. Certain slats are placed in the holes and welded to the tubes as described in more detail below. The slats cooperate with the seat rail tubes to which they are rigidly attached to form a rigid seat frame structure. The slats each have a uniform, slightly concave curvature, and in one embodiment, all slats are the same size and shape, have the same length, and are spaced apart with a uniform spacing along the length of the seat frame. The metal slats in the finished seat frame provide a generally horizontal seat surface 20 and an upright and generally rearwardly inclined backrest surface 22.

The seat frame 12 is elevated above the ground by left and right seat supports 24 and 26 rigidly affixed to the left and right sides of the seat frame, respectively. Although the design configuration of the seat support means can vary, in the illustrated embodiment the seat supports comprise metal support members in a composite configuration formed in an "hourglass" shape. In this embodiment, the left support member 24 includes a first angular section 28 extending upwardly and rearwardly from a first ground-engaging end 30 to a first reverse bend 32 which leads to a horizontal intermediate section 34 extending forwardly from the first reverse bend adjacent the seat frame to provide a left armrest. A second reverse bend 36 extends from the front end of the horizontal left armrest section and leads to a second angular section 40 extending downwardly and rearwardly at a second angle, terminating at a second ground-engaging end 42. The angular members 28 and 40 intersect at a point of intersection 44 spaced above the ground and in an elevation below the seat frame seat support surface 20. The structural members of the left seat support are welded together at the point of intersection 44 to provide a rigid left seat support structure.

Figure 2:
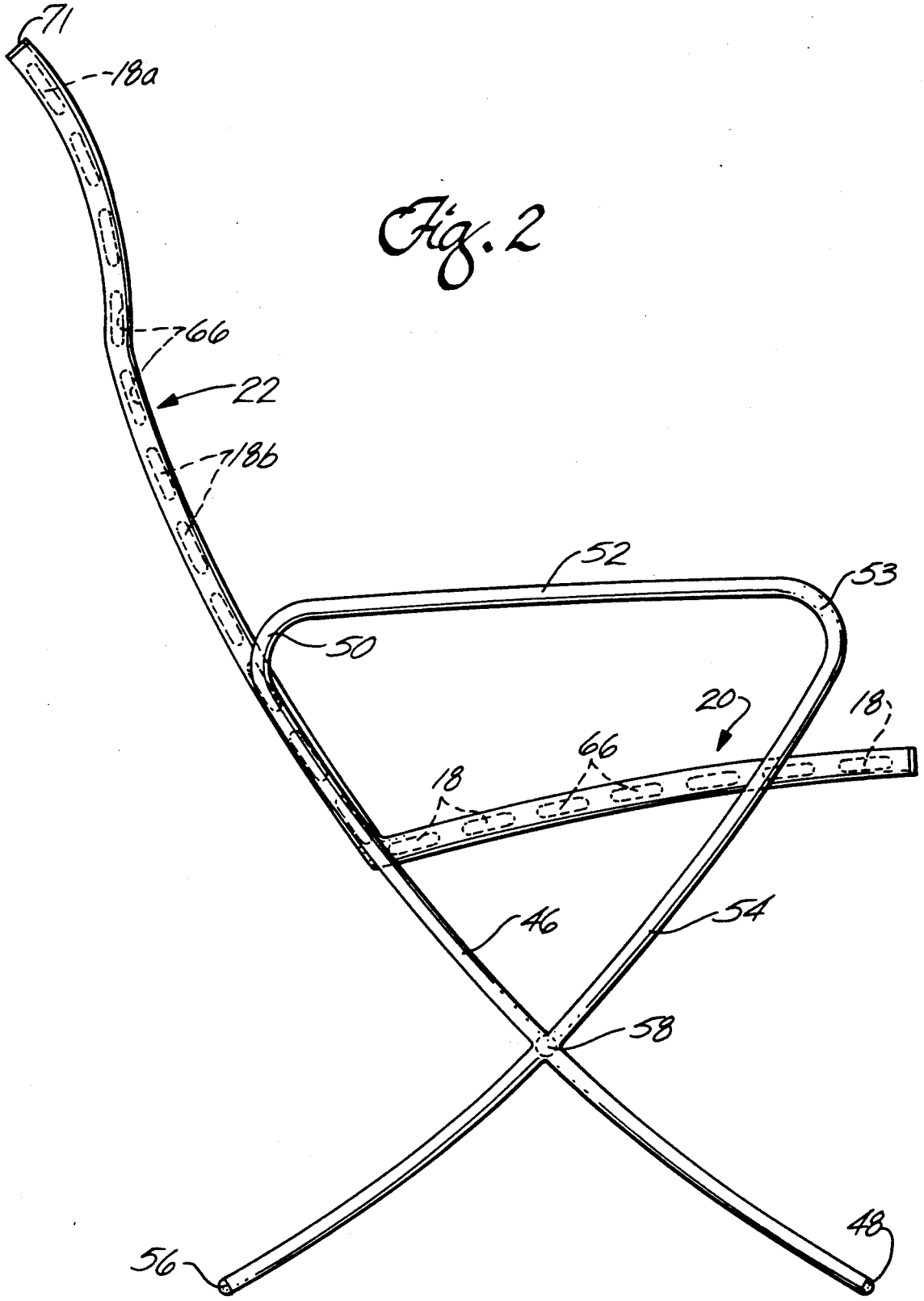
FIG. 2 is a side elevational view of the chair shown in FIG. 1.

The right seat support 26 (shown best in FIG. 2) is of similar composite configuration having sections which include an angular first section 46 extending upwardly and rearwardly from a first ground-engaging end 48 along a first angle to a first reverse bend 50 which leads to a right horizontal armrest section 52 extending forwardly to a second reverse bend 53 which continues into a second angular section 54 extending downwardly and rearwardly at a second angle, terminating at a second ground-engaging end 56. The angular members 46 and 54 intersect at 58 at the elevation of intersection 44, and the right structural members are welded together at the intersection 58 to form a rigid right seat support structure.

The lateral spacing between the left and right support members is maintained by an elongated rigid spreader bar 60 welded at its ends to the intersection points 44 and 58 of the left and right support frames.

The metal slats 18 rigidly affixed to the seat rails, particularly in the seat surface section 20 of the seat frame, provide further stretcher bars for adding rigidity to the chair frame structure.

The back section 22 of the seat frame is rigidly connected to the left and right seat support frames 24 and 26 by separate welds at 62 for rigidly affixing the left and right seat rail tubes to the angular sections 28 and 46 of the left and right support frame members, respectively. In addition, separate welds 64 rigidly affix front portions of the seat rails 14 and 16 of the seat frame to the sides of the angular members 40 and 54 of the left and right support members.

Figure 5:
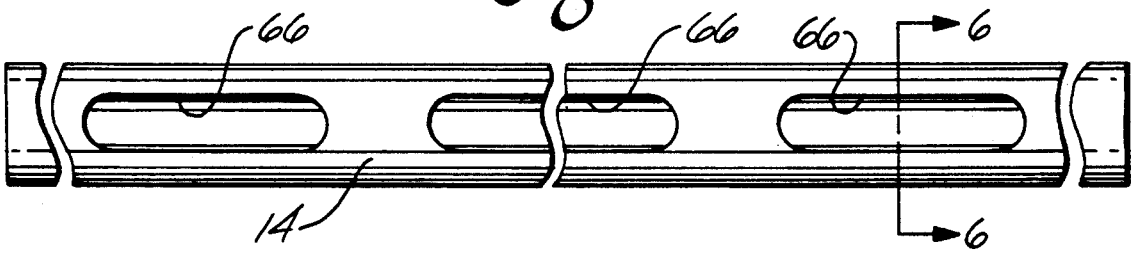
FIG. 5 is a fragmentary elevational view showing a seat rail tube with holes for receiving metal slats used in the chair of this invention.
Figure 6:
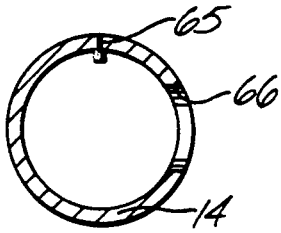
FIG. 6 is a cross-sectional view taken on line 6—6 of FIG. 5.

Although the shape of the metal structural members can vary, and the dimensions and arrangements of the structural members also can vary, the following description details the preferred structural configuration of the chair 10. The preferred seat rail tubes 14 and 16 are made of aluminum extrusions which have been rolled into a tube and electronically welded by a lengthwise seam 65 shown in FIG. 6. The tubes are preferably $\frac{7}{8}$ inch in diameter, and the wall of the tube is preferably 0.062 inch thick. The preferred configuration of the seat rail tubes is shown in FIGS. 5 and 6. Left seat rail tube 14 is shown in FIGS. 5 and 6; right seat rail tube 16 is identical. A plurality of separate and independent and preferably uniformly spaced apart elongated holes 66 are formed along the length of each tube. The holes 66 are preferably of uniform shape and have an elongated form with straight sides and curved ends shown best in FIG. 5. The long dimension of the holes is parallel to the length of the tube. In the preferred embodiment, each hole is preferably 1.82 inches long, with a width of about 0.375 inch. The preferred spacing between holes is about 0.75 inch between the ends of adjacent holes. The holes are aligned on a common axis and are formed along one side only of the tube.

Figure 3:
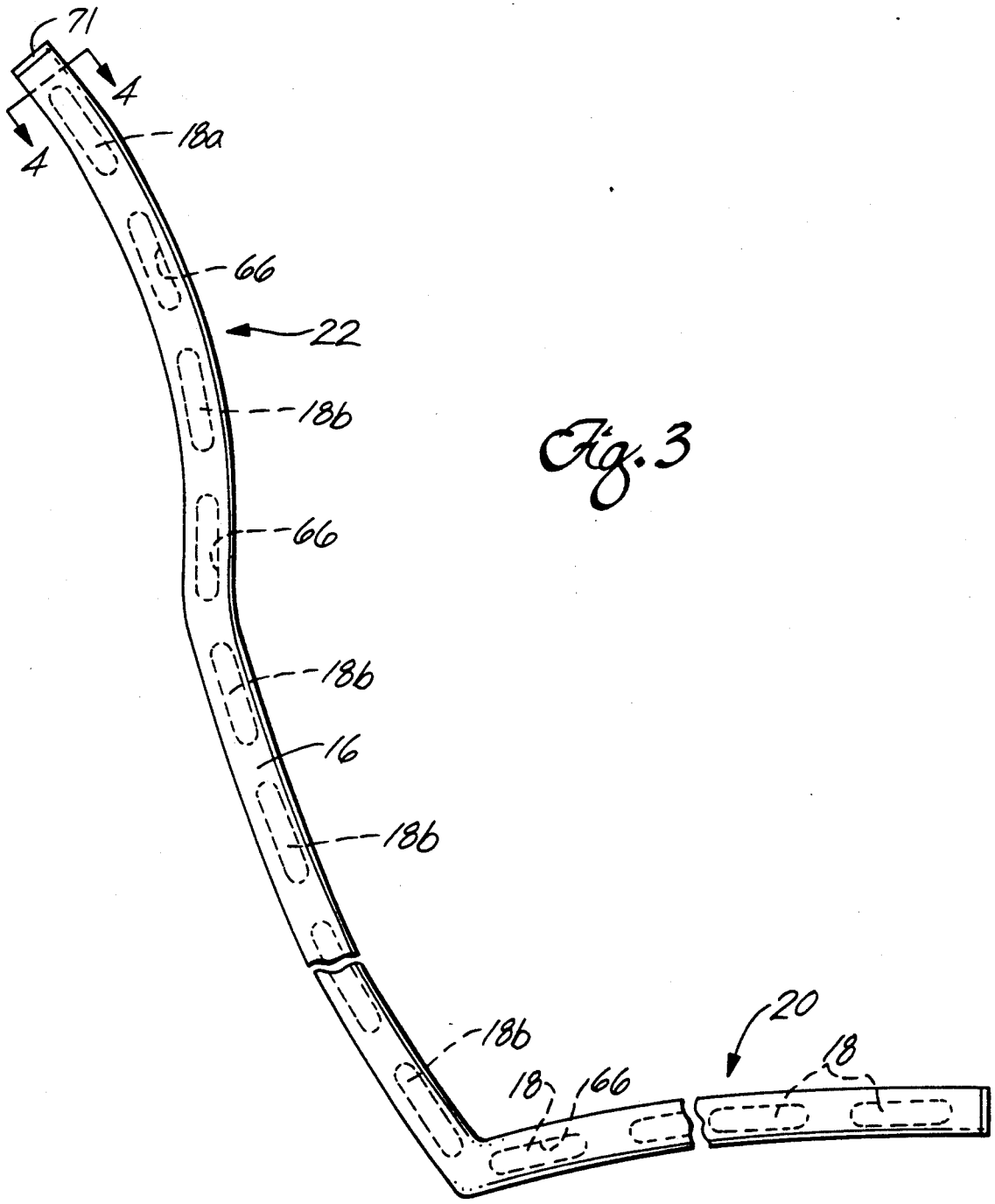
FIG. 3 is an enlarged side elevational view showing the seat frame portion of the chair of FIG. 2.

The preferred technique for forming the holes 66 in each tube is as follows. A mandrel (not shown) with an outside diameter that matches the inside diameter of the tube is placed inside the tube so that the mandrel provides support for the inside diameter of the tube circumferentially along the inside surface of the tube. The mandrel has a series of voids spaced apart along its length and matching the size, shape and spacing of the holes 66 to be formed in the tube. Each hole 66 is then punched in the wall of the tube with a separate die (not shown) that matches the shape of the holes 66. The dies are punched into the void spaces of the mandrel to form the holes while the remaining structure of the mandrel supports the wall of the tube to prevent it from collapsing as the holes are punched in the tube. The slugs remaining after the die punch step are then removed from the void spaces to provide a tube with spaced apart holes aligned on a common axis as shown best in FIGS. 3 and 5. Conventional mandrel type pierce tooling can be used to position multiple dies for punching the slotted holes in the tubing in a single step.

Figure 4:
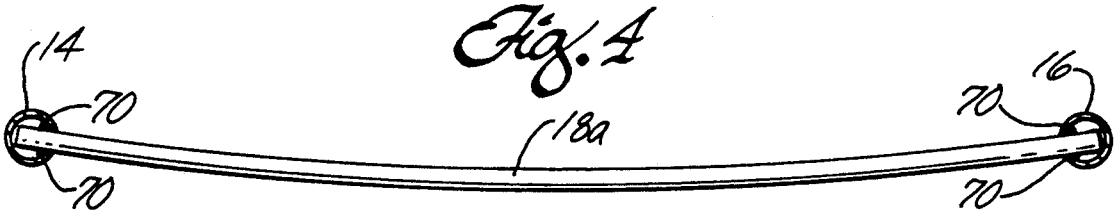
FIG. 4 is a cross-sectional view taken on line 4—4 of FIG. 3.
Figure 8:
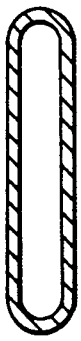
FIG. 8 is a cross-sectional view taken on line 8—8 of FIG. 7.

The metal slats 18 are preferably made of tubular aluminum extrusions with a narrow profile cross-section shown best at FIG. 8. The preferred tubular aluminum slats normally have a width (long dimension) of about 1.812 inches, a thickness or narrow dimension of about 0.375 inch, an exterior radius of about 0.1875 inch at each end, and a wall thickness of about 0.062 inch. Each slat is preferably roll formed along its length to a shallow curved configuration shown best in FIG. 4. The length of the slats can vary with the width of the seat frame seating surface, and in one embodiment, the slats are cut to a uniform length of about twenty inches each.

Continuing further with the preferred technique of manufacturing the chair, the curved slats 18 are next placed in corresponding holes 66 within a pair of straight, parallel seat tubes 14 and 16 to form a ladder type frame with the slats extending parallel to one another along the length of the straight seat rail tubes. The slats are positioned in the holes so that the ends of the slats extend into the holes and abut against the inside of each tube on the side of the tube opposite from each hole. This is shown best in FIG. 4. Further, the slats are arranged uniformly along the length of the tubes with the curved configurations of the slats being aligned uniformly along the length of the frame to form a uniform concave curvature of the slats between the seat rail tubes. After the slats are positioned in the seat rail tubes, the ladder type structure is placed in a former (not shown) to press form the seat rails into the generally L-shaped contour of the seat frame best illustrated in FIGS. 2 and 3.

Figure 7:
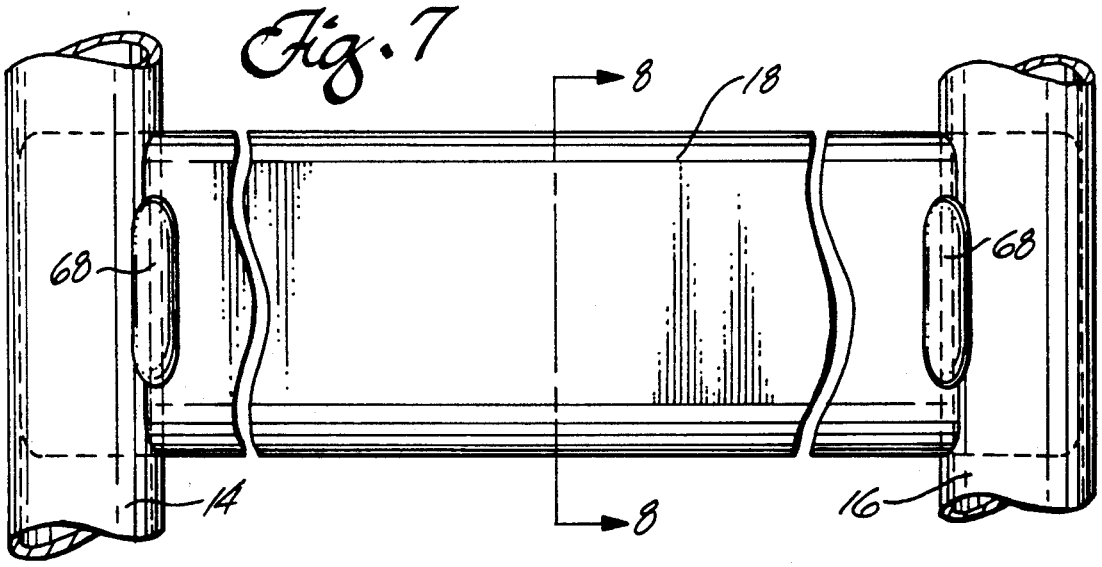
FIG. 7 is a fragmentary front elevational view showing a metal slat connected to a pair of seat rail tubes.

After the seat frame is formed in its L-shaped configuration, certain of the slats are then welded to the tubes to form a rigid chair frame structure. It is desirable to provide exterior welds 68 (shown in FIG. 7) for rigidly affixing each end of certain slats to their corresponding seat rail tubes. However, for aesthetic and design purposes, it is desirable that none of the exterior welds be visible in the finished chair. Therefore, in a preferred embodiment, the exterior welds shown in FIG. 7 are used only on the undersides of the slats in the seat surface portion 20 of the chair frame, for rigidly affixing each of the slats in the seating portion of the frame to the horizontal seat rail tubes of the L-shaped frame structure. Preferably, the uppermost slat (shown at 18*a* in FIGS. 2 and 3) on the upright chair back portion of the frame is welded to the inside of the seat rail tubes by welds 70 shown in FIG. 4. This welding step is carried out by removing the end caps 71 at the top of the seat rail tubes to expose the insides of the tubes and then welding the ends of the uppermost slat to the inside walls of the tubes. Welding the uppermost slat and the seat surface slats to the side tubes ties the entire structure together as a rigid unit. The remaining slats in the seat back portion of the chair frame (shown at 18*b*) need not be welded to the side tubes. The slats which are not welded are pinched at their ends to the inside walls of the tubes when the other welds are completed on the other slats, and this locks the unwelded slats in place in the seat frame as a rigid unit. The unwelded slats are held tightly in and between the seat rail tubes rigidly with essentially no movement relative to the tubes, while the welded slats provide stretcher bars that provide good rigidity for the entire chair frame structure.

Thus, the invention provides an outdoor patio chair made entirely of metal parts without additional fasteners for holding the structural members together. The all-metal chair lasts longer than other chairs made of plastic or wood and avoids the use of fabrics or the like which do not have the same weathering capacity as the all-metal chair. The invention is particularly useful for high volume uses because of its sturdy and weatherable properties. The invention also is highly design oriented because it can be made in designs to simulate a chair with wooden slats without the problems of wood frame chairs. In addition, the technique for making the chair frame makes it possible to construct the chair from light weight aluminum, and further design characteristics are enhanced because the welds at the ends of the slats are not visible in the finished chair.

What is claimed is:

1. A method for making a metal patio chair having a seat frame elevated above the ground by a supporting sub-structure, the seat frame being made by the steps comprising:

providing a pair of seat rails in the form of elongated metal tubes;

placing a mandrel inside each tube to reinforce the wall of the tube;

punching a series of spaced apart holes in the wall of the tube with the mandrel contained in the tube holding the shape of the tube while punching out the holes;

removing the mandrel from the tube;

providing a plurality of metal slats having a cross-sectional shape to match the shape of the holes punched in the seat rail tubes;

inserting the ends of the slats into corresponding pairs of the holes formed in the pair of seat rail tubes to form a ladder type frame in which opposite ends of the slats are held captive in corresponding holes in the seat rail tubes; and rigidly securing the captive slats to the seat rail tubes to lock the slats in place in the tubes to provide a rigid seat frame structure elevated above the ground by a supporting sub-structure to which the finished seat frame is attached.

2. The method according to claim 1 in which the mandrel has a void in the shape of each hole punched in the side rail tube.

3. The method according to claim 2 in which the mandrel outside diameter matches the inside diameter of the tube.

4. The method according to claim 1 to in which the voids in the mandrel are spaced apart along the mandrel with each void matching the cross-sectional shape of the corresponding hole punched in the tube.

5. The method according to claim 1 including punching each hole with a die in the shape of the hole.

6. The method according to claim 1 in which the tubes are made of aluminum.

7. The method according to claim 1 in which the slats are each curved.

8. Apparatus according to claim 1 in which the slats are tubular metal extrusions.

9. Apparatus according to claim 1 in which the slats are made of aluminum.

10. Apparatus according to claim 1 in which a slat at the end of the frame is welded to the inside of the side rail tubes.

11. The method according to claim 1 in which the slats are secured to the side rail tubes by welding.

12. The method according to claim 1 in which one or more slats are held in the tubes retained only by the surrounding wall of the hole, and welding other slats in the holes in the tubes to rigidly affix these slats in the tubes.

13. The method according to claim 1 including bending the side tubes to form a generally L-shaped seat frame and chair back after the slats are inserted into the side tubes.

* * * * *